United States Patent [19]

Card et al.

[11] Patent Number: 4,836,118

[45] Date of Patent: Jun. 6, 1989

[54] APPARATUS AND METHOD FOR PRODUCING A CUT LOOP OVERLAY OF A LOOP PILE BASE FABRIC IN A SINGLE PASS OF THE BASE FABRIC THROUGH THE TUFTING MACHINE

[75] Inventors: Roy T. Card; Joseph L. Card, both of Chattanooga, Tenn.

[73] Assignee: Card-Monroe Corporation, Chattanooga, Tenn.

[21] Appl. No.: 142,926

[22] Filed: Jan. 12, 1988

[51] Int. Cl.[4] ..... D05C 15/30

[52] U.S. Cl. ..... 112/80.41; 112/80.52

[58] Field of Search ..... 112/80, 41, 80.51, 80.52, 112/80.53, 80.72, 80.73, 80.45, 80.56

[56] References Cited

U.S. PATENT DOCUMENTS

| | | | |
|---|---|---|---|
| 3,025,807 | 3/1962 | Gerbert | 112/80.52 |
| 3,249,078 | 5/1966 | Nowicki | 112/80.41 |
| 3,396,687 | 8/1968 | Nowicki | 112/80.41 |
| 3,865,059 | 2/1975 | Jackson | 112/80.32 |
| 3,919,953 | 11/1975 | Card et al. | 112/80.45 |
| 4,366,761 | 1/1983 | Card | 112/80.41 |
| 4,658,739 | 3/1987 | Wakins | 112/80.31 |

*Primary Examiner*—Ronald Feldbaum

*Attorney, Agent, or Firm*—Hurt, Richardson, Garner, Todd & Cadenhead

[57] ABSTRACT

A conventional tufting machine is provided with front and back juxtaposed, laterally shiftable, needle bars positioned on a common needle bar support, the needles of the front needle bar cooperating with loop pile loopers and the needles of the back needle bar cooperating with cut-loop loopers. Yarn feed controls respectively feed yarns to the needles according to individual prescribed patterns. The needle bars are respectively shifted laterally according to individual prescribed patterns.

Tufted fabric produced by the machine is illustrated in which the loop tufts produced by the front needles are of relatively small cross section while the selectively cut or loop tufts produced by the back needles are of relatively large cross section. The large loop tufts are interspersed with small loop tufts due in part to lateral shifting of the needles.

10 Claims, 2 Drawing Sheets

APPARATUS AND METHOD FOR PRODUCING A CUT LOOP OVERLAY OF A LOOP PILE BASE FABRIC IN A SINGLE PASS OF THE BASE FABRIC THROUGH THE TUFTING MACHINE

BACKGROUND OF THE INVENTION

1. Field of the Invention

This invention relates to tufting machines, a method of producing tufts in a base fabric and a tufted fabric and is more particularly concerned with a cut and loop overlay of a loop pile based fabric in a single pass of the base fabric and apparatus and a method of producing the same.

2. Description of the Prior Art

In the past, tufting machines with laterally shiftable needles have been devised. U.S. Pat. No. 3,026,830 issued Mar. 27, 1962 to Bryant et al; U.S. Pat. No. 3,396,687 issued Aug. 13, 1986 to Nowicke; U.S. Pat. No. 4,366,761 issued Jan. 4, 1983 to Card and our U.S. Pat. No. 4,440,102 issued Apr. 3, 1984 all disclose tufting machines with laterally shiftable needle bars so as to permit a needle to selectively operate with one or two or more adjacent loopers.

U.S. Pat. No. 3,919,953 issued Nov. 18, 1975 to Card et al discloses a tufting machine employing two rows of needles, the front cooperating with a loop pile loopers and the back row with the cut pile loopers.

In the past, if it were desired to obtain a cut and loop overlay of a loop pile based fabric, it would have been necessary to use two machines, the loop pile base fabric being produced on one machine and the cut pile overlay being produced using a second machine. Of course, with the machine of U.S. Pat. No. 3,919,953, the cut pile could be sewn adjacent to the loop pile and thereby form a cover for the loops of the fabric.

SUMMARY OF THE INVENTION

Briefly described, the present invention includes a conventional tufting machine provided with a reciprocating needle bar support which, in turn, carries a pair of front and back, laterally shiftable needle bars positioned on the common needle bar supports. The needles of the front needle bar cooperate with the loop pile loopers and the needles of the back needle bar cooperate with the cut-loop loopers. Yarn feed controls respectively feed yarn to the needles according to individual prescribed patterns. The needle bars are respectively shifted laterally in accordance with individually prescribed patterns.

The tufted fabric produced by the machine of the present invention has high or low loop tufts produced by a front row of needles and are relatively small in cross section while the selectively cut or loop tufts produced by the back needles are relatively large cross section. The large loop pile tufts are interspaced with the small loop pile tufts, due in part to the lateral shifting of the needles.

Accordingly, it is an object to the present invention to provide a machine capable of producing a cut and loop overlay of a loop pile base fabric in a single pass of the base fabric through the tufting machine.

Another object to the present invention is to provide a tufting machine capable of sewing a dense close gauge loop and cut fabric.

Another object to the present invention is to provide a machine capable of producing a cut pile overlay of a loop pile base fabric without using two machines.

Another object of the present invention is to provide a tufting machine capable of producing a tufted product having a loop pile base which can be of one color and a cut loop overlay which can be of a different color of textured yarn.

Another object of the present invention is to provide a tufting machine capable of producing a tufted fabric having cut pile and cut-loop pile of approximately the same pile height.

Another object of the present invention is to provide a tufting machine which can produce a patterned tufted product in which the cut pile are higher than the looped pile.

Other objects, features and advantages of the present invention will become apparent from the following description when considered in conjunction with the accompanying drawing wherein like characters of reference designate corresponding parts throughout the several used.

DETAILED DESCRIPTION

Figure 1:
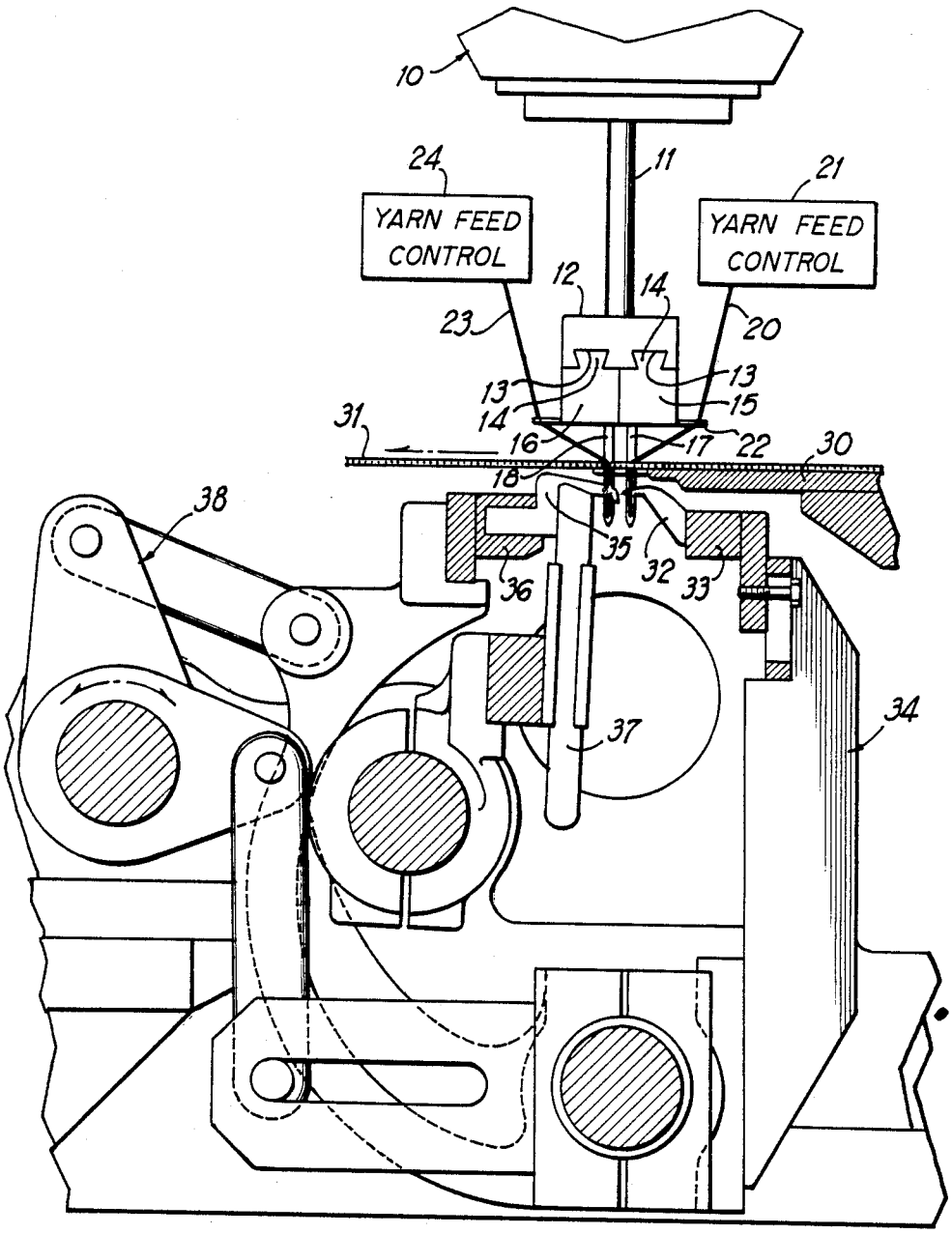
FIG. 1 is a fragmentary schematic of vertical sectional view of a tufting machine constructed in accordance with the present invention.

Referring in detailed to the embodiment chosen for the purpose of illustrating the present invention, numeral 10 denotes generally a conventional tufting machine which has push rods 11 which are reciprocated along their respective axes upwardly and downwardly, the push rods 11 being provided at the lower end with a needle bar support 12. This needle bar support has along its lower surface a pair of dovetailed, parallel, laterally extending slots 14 which respectively receive the dovetails of a pair of needle bars of 15 and 16. The needle bar 15 is provided with a row of relatively small front needles 17 and the rear needle bar is provided with a row of relatively large needles 18. Small or thin yarns 20 are fed from a yarn feed control 21 through a yarn guide 22 to the small needles 17 while relatively large or thick yarns 23 are fed from a yarn feed control 24 by a yarn guide 25 to the needles 18.

The tufting machine 10 also includes a bed 30 over which is passed a backing material 31, the backing material passing beneath the needles 17 and 18 so that the needles insert yarn through the backing material upon reciprocation of the needle bar support 12.

Below the backing material 31, the tufting machine 10 is provided with a plurality of loop pile loopers 32 which respectively cooperate with the needles 17 so as to catch and hold the loops of yarn sewn by these needles. The loopers 32 are carried by a looper block 33 supported by a rocker assembly denoted generally by the numeral 34.

A plurality of forwardly extending cut-loop loopers 35 are arranged to cooperate with the back needles 18, these loopers being carried by looper block 36 and being provided, respectively, with knives, such as knife 37. The back loop cut loopers 35 are rocked back and forth by a looper assembly, denoted generally by the numeral 38.

Figure 3:
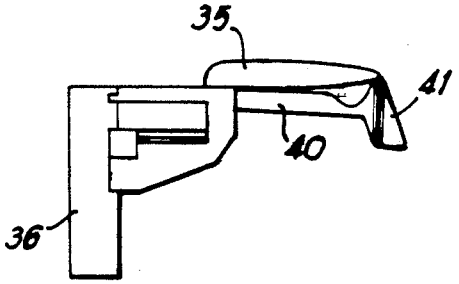
FIG. 3 is a view of a tufted fabric produced according to the present invention.
Figure 4:
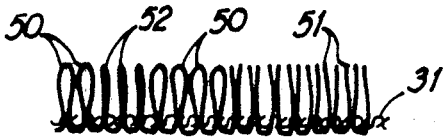

Since the structure and operation of these loopers 32 and 35 are essentially identical to the operation of the loopers shown in U.S. Pat. No. 3,919,953 issued Nov. 18, 1975 no more detailed description of the operation of the loopers is deemed necessary. Suffice it to state that the loop pile loopers face 32 rearwardly and are reciprocated so as to protrude between each needle 17 and its yarn so as to catch and temporarily hold the loop thus formed by the needle 17 on each reciprocation. Furthermore, the cut-loop loopers 35 face forwardly and are reciprocated so as to catch the loops sewn by the back needles 18. Each cut-loop looper 35 is provided with a spring clip 40 as illustrated in FIG. 3, the spring clip 40 is secured to the base or shank of the looper 35 and extends forwardly along one side of each looper 35 so as to provide a camming member 41 at its end which is held open by the needle. In the event that sufficient yarn is fed to the particular needle 18, with which a looper 35 is cooperating, a loop will be formed which is retained by looper 35 and subsequently is cut to form a cut tuft or pile; whereas, if insufficient yarn is fed to needle 18, the yarn will be jerked off of looper 35 as needle 18 holds the clip 40 open.

Since the operation of a cut-loop looper 35 and its clip 40 is well known, no more detailed description of the cut-loop looper is deemed necessary, except to state that the yarn feed mechanism 24 controls the amount of yarn 23 fed to a particular needle and determines whether the loop caught by looper 35 will remain on the looper 35 and therefore be cut or whether it will be jerked off of the looper 35 and thus produce a loop.

According to the present invention, the needle bar 15 is provided with a needle shift control 45 which is connected through a link 46 to the needle bar 15 so as to move the needle bar 15 laterally either left or right and thus position a needle 16 in position for cooperating with a looper 32, to the left or to the right of its original looper 32. Thus, the needle shift control 45 shifts the needle bar 15 in increments equal to the spacing between adjacent needle 16 or the spacing of adjacent loopers 13. In like fashion, the needle bar 16 is provided with a needle shift control 47 which is connected thereto through a link 48. The needle shift control 47 shifts the needle bar 16 in increments equal to the distance between needles 18, either to the left or right so as to enable the needles 18 to cooperate with loopers 35 to the left or right of its normal or original looper 35.

Figure 2:
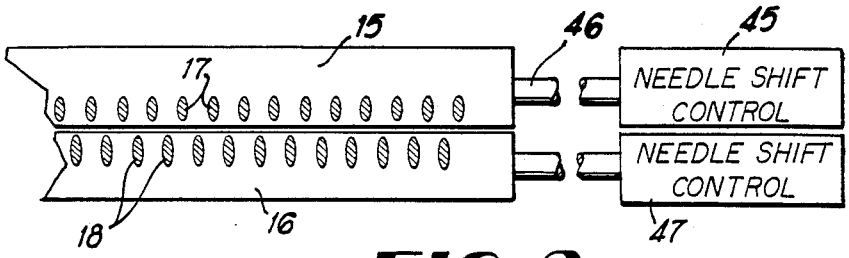
FIG. 2 is a schematic fragmentary view of a portion of the machine shown in FIG. 1, the needle bars being illustrated as being controlled by individual needle shift controls.

As shown in FIG. 2, the back needles 18 are larger than the front needles 16 and therefore can sew larger yarn which subsequently will produce fat loops 50 in the backing material 31, as illustrated in FIG. 5. The large yarns 24 also produce the cut pile 51 as dictated by the yarn feed control 24. The yarns 20 will create the thin loops 52 which can either be high loops or low loops as dictated by yarn feed control 21.

Through the operation of the needle shift control 45, the needle 16 are caused to sew a zig-zag pattern or straight pattern of either high or low loops, such as loops 52. Through the operation of needle shift control 47 the needles 18 are caused to sew the large yarns 23 in a zig-zag pattern or a straight pattern, to produce the cut piles 51 and the fat loops 50.

By such a manipulation of the needle shift controls 45 and 47 and the control of the thin yarns 20 and the fat yarns 23 through the yarn feed controls 21 and 24, a quite pleasing multicolor or single color tufted fabric is produced wherein the cut pile appear to be about the same height as the long loops 50 and 52. Furthermore the cut pile 51 can hide the fat loops 50 in the event that the fat loops 50 are low loops as dictated by the yarn feed control 54.

It will be understood that the loopers 32 and 35 are staggered with respect to each other so that the loops of yarn which are produced by the small yarns 20 will pass between adjacent cut-loop loopers and not become entangled therewith.

It will be obvious to those skilled in the art that many variations may be made in the embodiment here chosen for the purpose of illustrating the present invention, without departing from the scope thereof as defined claims.

We claim:

1. A tufting machine through which backing material is fed, comprising:

(a) a needle bar support on one side of said backing material;

(b) means for reciprocating said needle bar support;

(c) a bed adjacent to said needle bar support over which said backing material is passed;

(d) a front needle bar carried by said needle bar support;

(e) a back needle bar carried by said needle bar support;

(f) front needles protruding from said front needle bar for inserting yarns through said backing material when said front needle bar reciprocates so as to produce successive loops of yarns in said backing material;

(g) rear needles protruding from said rear needle bar for inserting successive loops of yarns through said backing material when said rear needle bar is reciprocated; so as to sew successive loops of yarns through said backing material;

(h) a first yarn control for controlling the feed of yarns to said front needles;

(i) a second yarn control for controlling the feed of yarns to said rear needles;

(j) a plurality of loop pile loopers disposed on the other side of said backing material for catching loops of yarn sewn by said front needles;

(k) a plurality of cut-loop loopers disposed on the other side of said backing material to catch the loops of yarn sewn by said backing needles; said second yarn control selectively determining through the feed of yarns to said back needles whether the cut-loop loopers cut or release without cutting selected loops from said cut-loop loopers;

(l) yarn feed controls for feeding yarn to said back needles; and (m) a shift control for shifting one of the needle bars laterally to cause the needles of the selected needle bar to cooperate selectively with selected ones of a plurality of loopers which are capable of cooperating with the needles of the selected needle bar.

2. The tufting machine defined in claim 1 wherein said back needles are larger than said front needles and wherein the yarns fed to said back needles are larger than the yarns fed to said front needles.

3. The tufting machine defined in claim 2 wherein said front yarn control controls the feed of yarn to said front needles so as to produce high and low loops from said yarns for said front needles.

4. The tufting machine defined in claim 1 wherein the other of the needle bars is moveable laterally with the respect to said needle bar support and a needle shift control for controlling the shifting of said other of the needle bars.

5. The tufting machine defined in claim 4 wherein said front yarn control controls the feed of yarns to said front needles for producing high and low loops in said backing material from the yarns fed to said front needles.

6. Method of tufting comprising: passing a backing material along a prescribed path, arranging two transverse rows of needles on one side of said path for simultaneously inserting yarns carried by said needles through said backing material for forming loops in transverse and longitudinal rows of tufts in the backing material, catching said loops formed by one row of needles and selectively cutting or releasing without cutting the caught loops of said one row of needles, forming high and low loops from the loops of the other row of needles and laterally moving one row of needles with respect to the other row of needles as they are reciprocated.

7. The method defined in claim 6 wherein successive cut loops formed by yarn from a prescribed needle respectively cover low loops produced in more than one longitudinal row of tufts.

8. The method defined in claim 7 including laterally shifting the other row of needles.

9. The method defined in claim 7 wherein said one row of needles is rearwardly of said other row of needles along said prescribed path.

10. The tufting machine defined in claim 1 including means for laterally shifting the other of said needle bars, independent of the shifting of said one of said needle bars.

* * * * *